US007257363B2

(12) United States Patent
Baker et al.

(10) Patent No.: US 7,257,363 B2
(45) Date of Patent: Aug. 14, 2007

(54) DEVICE FOR MOVING TONER WITHIN AN IMAGE FORMING DEVICE

(75) Inventors: Christopher Lee Baker, Harrodsburg, KY (US); Benjamin Alan Askren, Lexington, KY (US); Donn Duane Bryant, Lexington, KY (US); Derek Masami Inouye, Lexington, KY (US); Lenci Robert Kappes, Lexington, KY (US); Edward Lynn Triplett, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 173 days.

(21) Appl. No.: 11/233,326

(22) Filed: Sep. 22, 2005

(65) Prior Publication Data

US 2007/0065196 A1 Mar. 22, 2007

(51) Int. Cl.
*G03G 21/00* (2006.01)
*G03G 21/12* (2006.01)

(52) U.S. Cl. ..... 399/358; 399/120; 399/359; 399/360

(58) Field of Classification Search ..... 399/119, 399/120, 358, 359, 360, 257
See application file for complete search history.

(56) References Cited

U.S. PATENT DOCUMENTS 3,483,679 A 12/1969 Balbierer
3,924,566 A 12/1975 Dennie
3,927,937 A 12/1975 de Keyzer
4,029,047 A 6/1977 Bell
4,030,824 A 6/1977 Smith
4,251,155 A 2/1981 Schnall et al.
4,281,981 A 8/1981 Feldman
4,436,413 A 3/1984 Oka
4,530,594 A 7/1985 Adachi
4,593,997 A 6/1986 Fox et al.
4,601,569 A 7/1986 Garris
4,627,716 A 12/1986 Oka
4,630,653 A 12/1986 Kan
4,650,312 A 3/1987 Vineski
4,659,212 A 4/1987 Ichihara et al.
4,660,960 A 4/1987 Fukunaga et al.
4,711,561 A 12/1987 Tsuruoka
4,739,907 A 4/1988 Gallant
4,819,030 A 4/1989 Shibano
4,819,578 A 4/1989 Koiso et al.
4,849,791 A 7/1989 Hagihara et al.
4,860,056 A 8/1989 Kano et al.
4,870,449 A 9/1989 Brown
4,891,678 A 1/1990 Ishizu et al.

(Continued)

*Primary Examiner*—Hoang Ngo
(74) *Attorney, Agent, or Firm*—Coats & Bennett, PLLC

(57) ABSTRACT

Embodiments of a device to move waste toner within an image forming device. In one embodiment, waste toner is formed during the image formation process. The waste toner is captured and moved through a first conduit. The conduit includes an outlet for passing the waste toner to a second conduit. The door is positionable between an open orientation to allow the waste toner to discharge into the second conduit, and a closed orientation. The second conduit includes an inlet for receiving the waste toner. The interface between the first and second conduits allows for the door to move between the open and closed orientations. The interface also greatly reduces or prevents the waste toner from leaking as it passes from the first conduit into the second conduit.

20 Claims, 7 Drawing Sheets

U.S. PATENT DOCUMENTS 4,937,628 A 6/1990 Cipolla et al.
4,941,022 A 7/1990 Ohmura et al.
4,943,830 A 7/1990 Sulenski
4,958,196 A 9/1990 Fujii et al.
4,974,031 A 11/1990 Koiso et al.
4,982,230 A 1/1991 Ogura et al.
4,982,231 A 1/1991 Matsuuchi
4,985,734 A 1/1991 Honda et al.
5,031,001 A 7/1991 Kusumoto
5,038,180 A 8/1991 Niki
5,113,227 A 5/1992 Miyasaka
5,128,724 A 7/1992 Hayashi et al.
5,130,756 A 7/1992 Taniyama
5,132,740 A 7/1992 Okamoto et al.
5,138,394 A 8/1992 Watanabe et al.
5,175,588 A 12/1992 Katagata
5,187,524 A 2/1993 Cherian
5,257,077 A 10/1993 Peters, Jr. et al.
5,260,755 A 11/1993 Imaizumi
5,264,900 A 11/1993 Momiyama et al.
5,270,785 A 12/1993 Kita et al.
5,303,008 A 4/1994 Kalyandurg et al.
5,309,211 A 5/1994 Yoshioka
5,341,199 A 8/1994 Thorp et al.
5,349,427 A 9/1994 Benedict et al.
5,355,199 A 10/1994 Bray
5,383,578 A 1/1995 Nishimura
5,400,127 A 3/1995 Arai et al.
5,402,216 A 3/1995 Komaki et al.
5,440,376 A 8/1995 Hagihara
5,444,522 A 8/1995 Owens, Jr.
5,455,665 A 10/1995 Baba et al.
5,500,716 A 3/1996 Morishita et al.
5,517,285 A 5/1996 Nomura et al.
5,534,988 A 7/1996 Gerbasi
5,541,714 A 7/1996 Watanabe et al.
5,585,894 A 12/1996 Araya et al.
5,594,541 A 1/1997 Bonislawski, Jr. et al.
5,617,195 A 4/1997 Torimaru et al.
5,634,186 A 5/1997 Villalobos-Garcia et al.
RE35,529 E 6/1997 Michlin
5,638,160 A 6/1997 Vollenbroek
5,671,461 A 9/1997 Ishii
5,708,952 A 1/1998 Taniguchi et al.
5,715,502 A 2/1998 Taniguchi et al.
5,740,499 A 4/1998 Higeta et al.
5,742,882 A 4/1998 Lee
5,822,653 A 10/1998 Ishii
5,875,382 A 2/1999 Inoue
5,918,085 A 6/1999 Rollins et al.
5,923,931 A 7/1999 Kishimoto
5,933,690 A 8/1999 Sugimoto et al.
5,937,235 A 8/1999 Huss et al.
5,995,774 A 11/1999 Applegate et al.
5,995,783 A 11/1999 Garcia et al.
6,014,541 A 1/2000 Kato et al.
6,044,238 A 3/2000 Rodriguez
6,055,405 A 4/2000 Knott et al.
6,085,062 A 7/2000 Mizuishi et al.
6,118,958 A 9/2000 Nagashima
6,154,619 A 11/2000 Boockholdt et al.
6,266,511 B1 7/2001 Murakami et al.
6,298,217 B1 10/2001 Murayama et al.
6,308,036 B1 10/2001 Taniyama et al.
6,418,297 B1 7/2002 Yamatani et al.
6,459,866 B1 10/2002 Meguro
6,463,254 B1 10/2002 Maul et al.
6,505,026 B2 1/2003 Hayakawa et al.
6,510,304 B2 1/2003 Abramsohn
6,526,243 B2 * 2/2003 Kim et al. ..... 399/119
6,546,225 B2 4/2003 Wang
6,552,780 B1 4/2003 Michlin et al.
6,671,474 B2 12/2003 Chadani
6,678,483 B2 1/2004 Brown et al.
6,738,591 B2 5/2004 Hattori et al.
6,760,556 B2 7/2004 De Kesel et al.
6,782,235 B2 * 8/2004 Serizawa et al. ..... 399/360
6,882,821 B2 * 4/2005 Jeong et al. ..... 399/358
2003/0044192 A1 3/2003 Brown
2003/0156859 A1 8/2003 Tamai

* cited by examiner

DEVICE FOR MOVING TONER WITHIN AN IMAGE FORMING DEVICE

BACKGROUND

Image forming devices form images through a toner transfer process that transfers toner particles to a media sheet. The process includes forming a latent image on a photoconductive member with a laser device. The toner particles originally stored in a reservoir are attracted to the latent image and transferred from the reservoir to the photoconductive member. The toner particles on the photoconductive member are than passed either directly to the media sheet, or transferred to an intermediate member and then transferred to the media sheet. During the toner transfer process, some toner particles are not transferred and remain on the photoconductive member or intermediate member. These particles should be removed prior to forming the next toner image.

The removed toner particles, also referred to as waste toner, may be transported within the image forming device and stored for disposal. Alternatively, the waste toner may be recycled and re-introduced back into the reservoir for forming a subsequent toner image. In either event, the waste toner should be transported in a leak-free system. The transport system may include conduits that lead from one section of the image forming device to a second section of the device. Further, the transport system may pass or hand-off the waste toner from a first conduit to a second conduit.

The waste toner has the consistency of a fine powder that is prone to leak from the transport system. Small cracks or openings in the transport system, such as at the hand-off areas of one conduit to a second conduit, may result in toner leakage. Waste toner that leaks from the transport system gathers within the interior of the image forming device. The leaked toner may attach to a media sheet moving through the device resulting in a print defect. Alternatively, the leaked toner may attach to a user, such as when the user is replacing a cartridge or other internal component. Either leakage situation is problematic and should be kept to a rare occasion, or completely eliminated.

SUMMARY

The present application is directed to embodiments of a device to move waste toner within an image forming device. In one embodiment, waste toner is formed during the image formation process. The waste toner is captured and moved through a first conduit. The conduit includes an outlet for passing the waste toner to a second conduit. The door is positionable between an open orientation for the waste toner to discharge into the second conduit, and a closed orientation. The second conduit includes an inlet for receiving the waste toner. The interface between the first and second conduits allows the door to move between the open and closed orientations. The interface also greatly reduces or prevents the waste toner from leaking as it passes from the first conduit into the second conduit.

DETAILED DESCRIPTION

Figure 1:
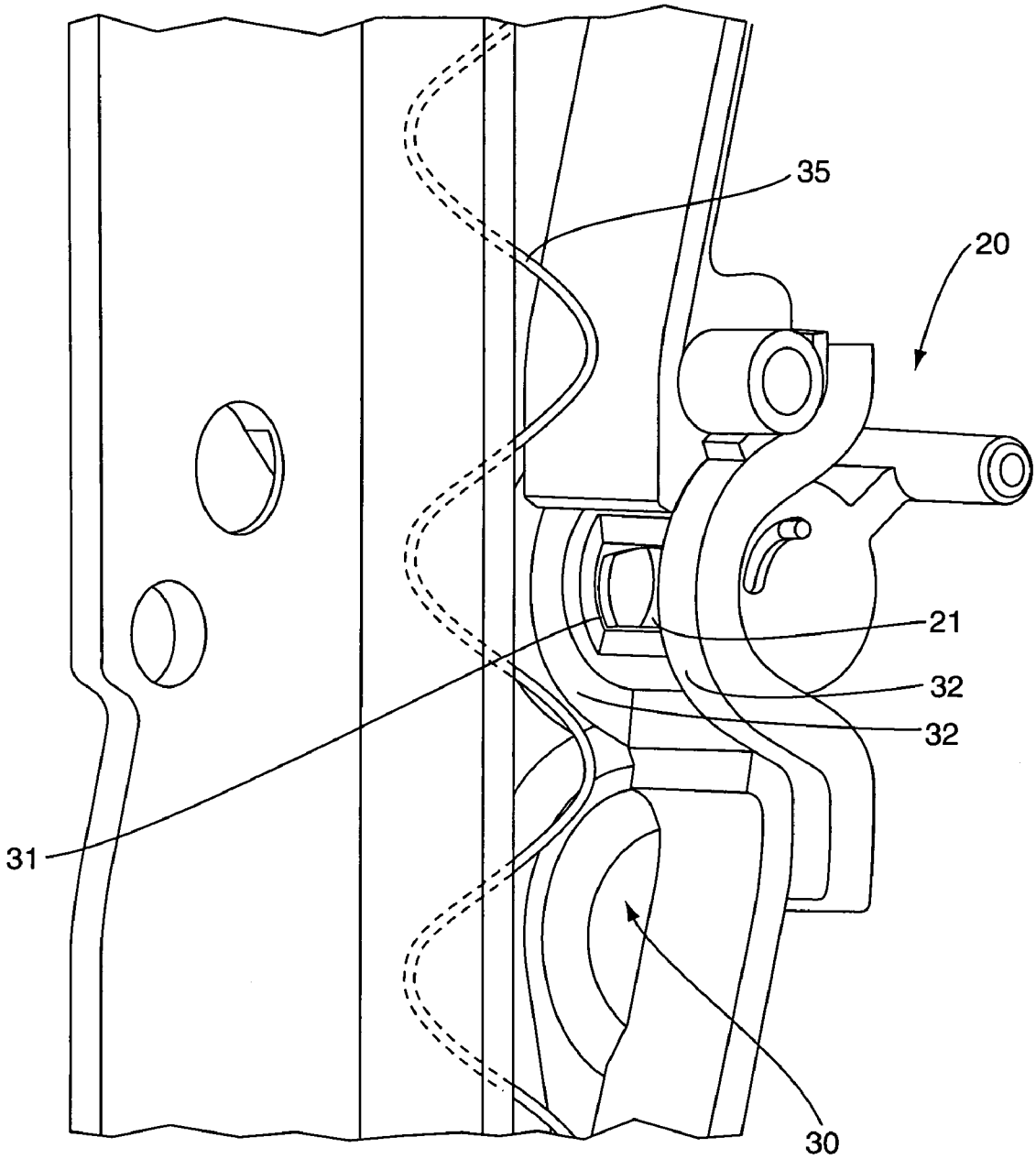
FIG. 1 is a cut-away perspective view of a first section of a waste toner system connected with a second section according to one embodiment of the present invention.

The present application is directed to embodiments for moving waste toner within an image forming device. FIG. 1 illustrates one embodiment of a toner transport system that transfers toner from a first section to a second section. The first section includes an outlet port that aligns with an opening in the second section. The outlet port is sized and aligned to reduce and/or prevent waste toner leakage. These members also prevent clogging of the waste toner as it moves through the sections.

Figure 2:
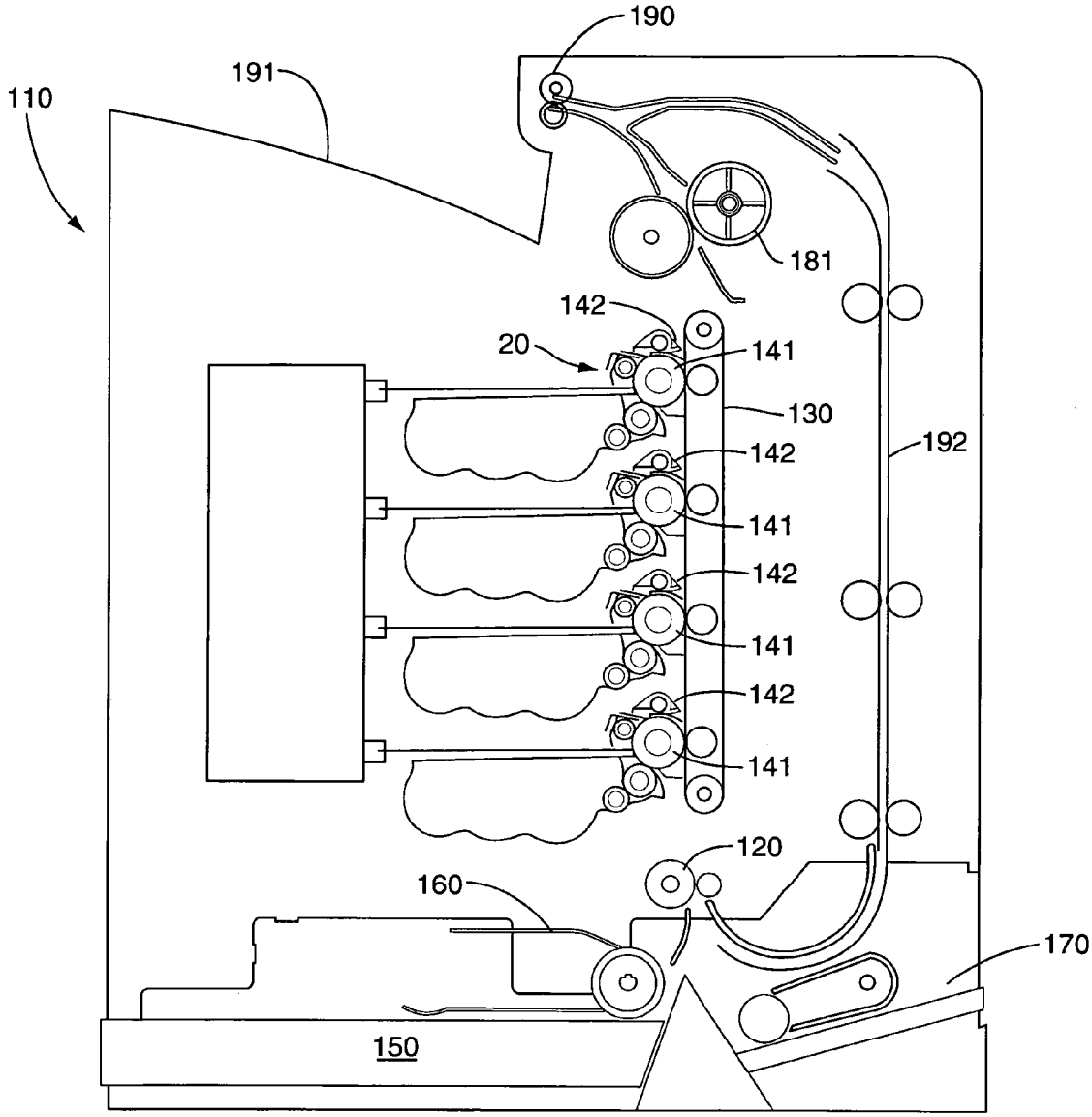
FIG. 2 is a schematic view of an image forming device according to one embodiment of the present invention.

The present embodiments are better understood within the context of the workings of an image forming device. FIG. 2 depicts a representative image forming device, such as a printer, indicated generally by the numeral 110. A media tray 150 with a pick mechanism 160, or a manual input 170, is a conduit for introducing media sheets into the device 110. The media sheet is moved from the input and fed into a primary media path. One or more registration rollers 120 align the media sheet and precisely control its further movement along the media path. A media transport belt 130 forms a section of the media path for moving the media sheet past a plurality of toner cartridges 20. Color devices typically include four cartridges 20 for printing with cyan, magenta, yellow, and black toner to produce a four-color image on the media sheet.

The media sheet with loose toner is then moved through a fuser 181 that adheres the toner to the media sheet. Exit rollers 190 rotate in a forward or a reverse direction to move the media sheet to an output tray 191 or a duplex path 192. The duplex path 192 directs the inverted media sheet back through the image formation process for forming an image on a second side of the media sheet.

During image formation, the device 110 forms a latent image on a photoconductive member 141 that is within each of the cartridges 20. Each photoconductive member 141 rotates past a toner reservoir and the toner is attracted to the latent image. The photoconductive member 141 with toner then rotates further and transfers the toner image onto the media sheet that is passing along on the transfer belt 130. Residual toner, referred to as waste toner, that remains on the photoconductive drum 141 after toner transfer is removed by a removal mechanism 142. The removal mechanism 142 includes a channel 145 (FIGS. 6 and 7) formed within the interior of the cartridge 20. The channel 145 includes an auger 144 that rotates to move the waste toner laterally along the channel 145.

Figure 3:
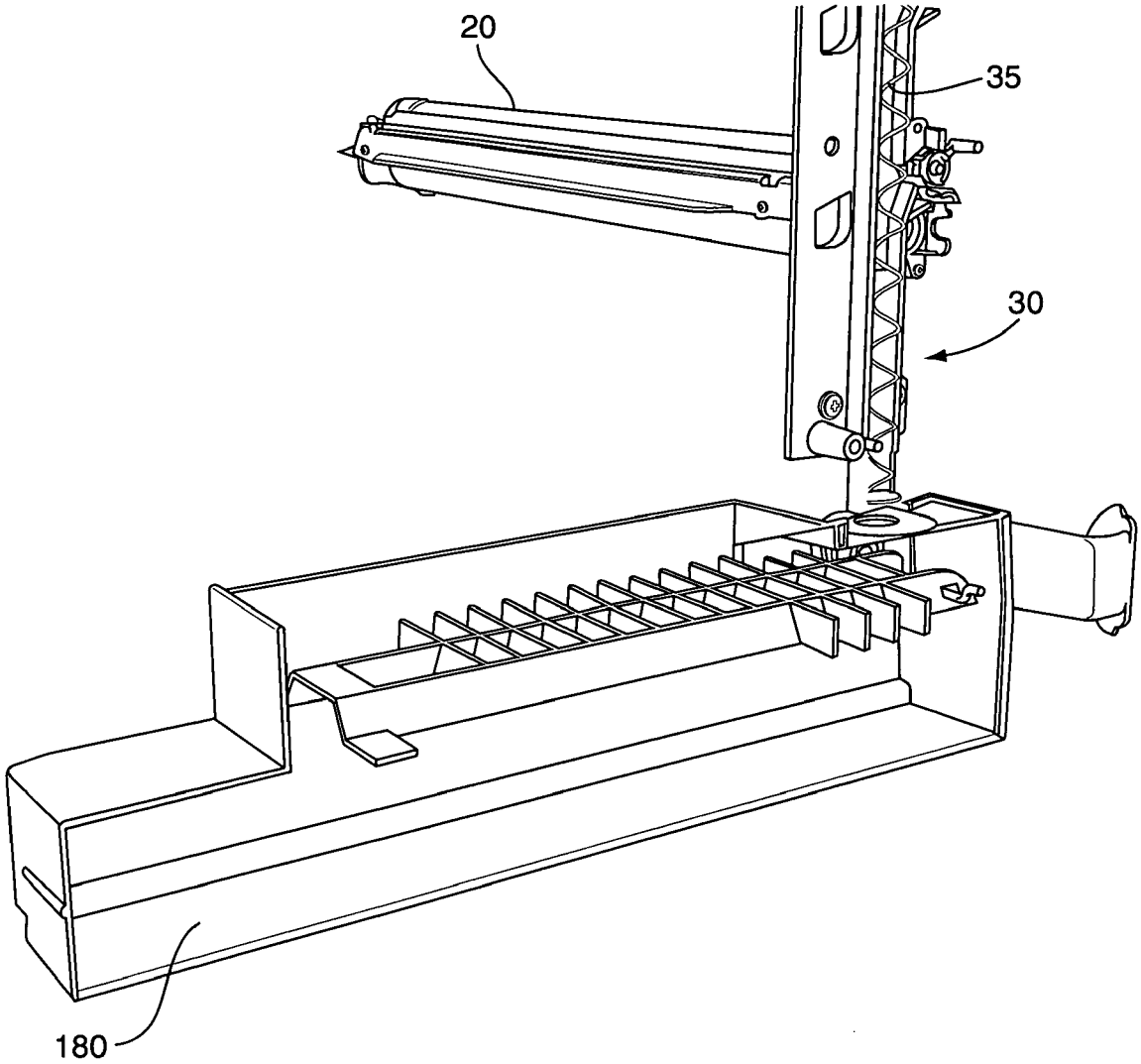
FIG. 3 is a partial perspective view illustrating a cartridge connected to a toner chute according to one embodiment of the present invention.

FIG. 3 illustrates one of the cartridges 20 attached to a waste toner chute 30. Waste toner from the cartridge 20 is moved by the auger 144 through the channel 145 and transferred to the waste toner chute 30. An auger 35 may be positioned within the waste toner chute 30 to rotate and prevent the waste toner from becoming clogged. A waste toner reservoir 180 is positioned at the bottom of the waste toner chute 30 to permanently store the waste toner received from each of the cartridges 20. The waste toner chute 30 is vertically orientated to utilize gravity in moving the waste toner into the reservoir 180.

Figure 4:
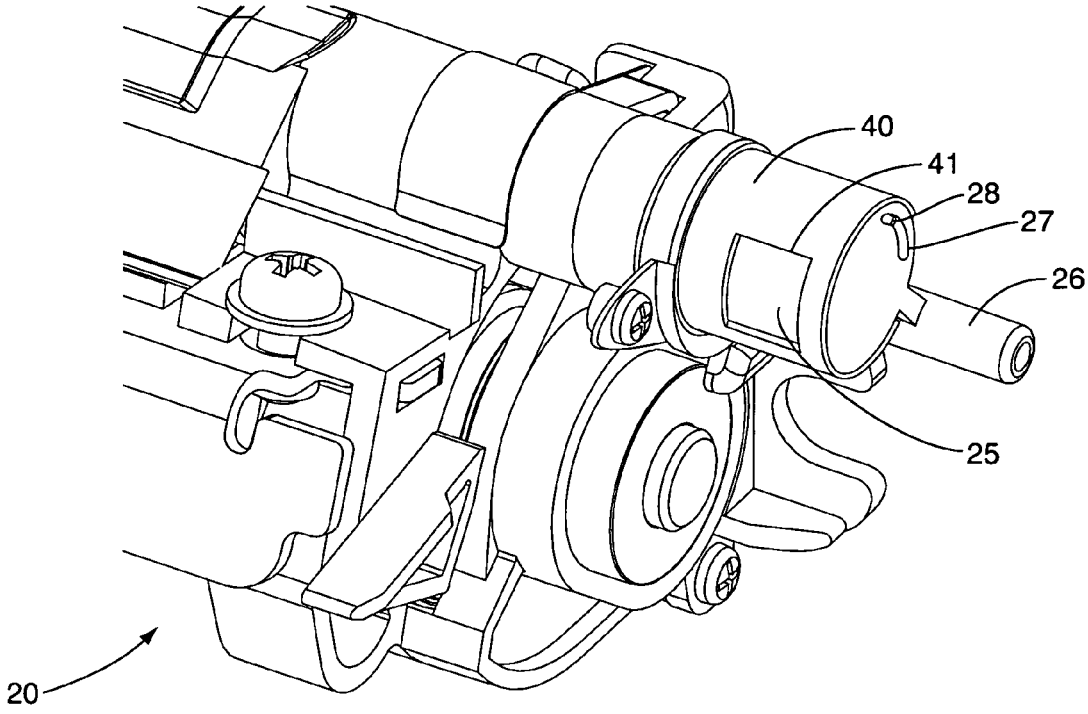
FIG. 4 is a partial perspective view of one end of the cartridge with a door in a closed orientation according to one embodiment of the present invention.
Figure 5:
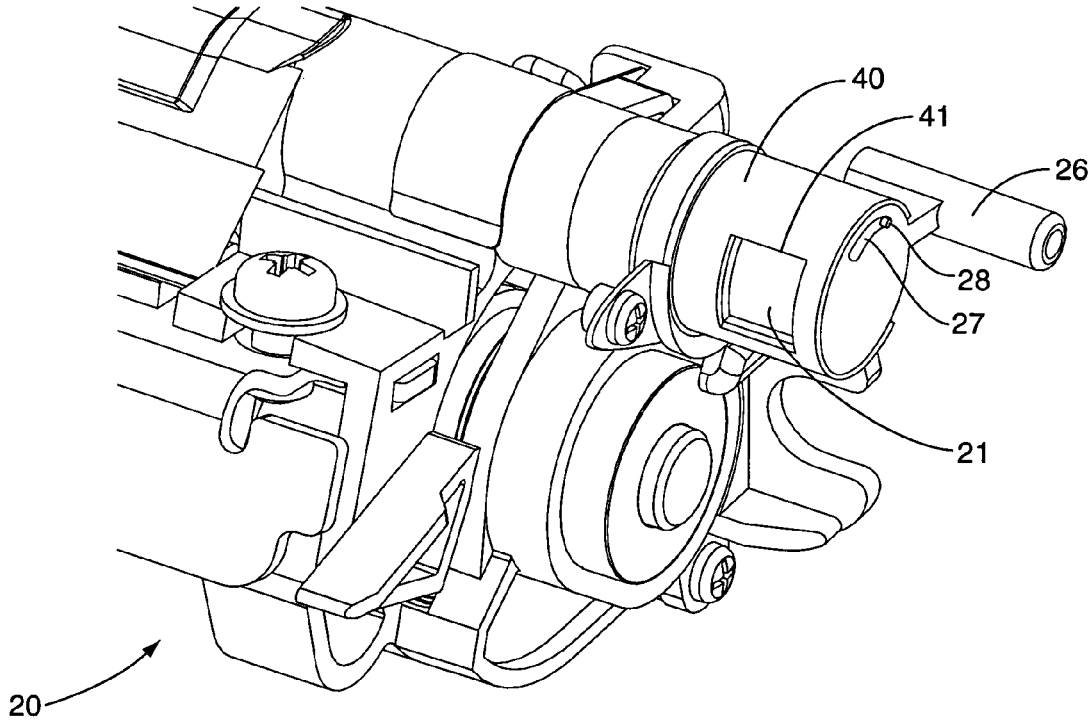
FIG. 5 is a partial perspective view of one end of the cartridge with a door in an open orientation according to one embodiment of the present invention.

The transfer of the waste toner from the cartridge 20 into the waste toner chute 30 occurs with no leakage. FIGS. 4 and 5 illustrate an end of the cartridge 20 that attaches to the waste toner chute 30. The cartridge 20 includes an outlet port 21 for transferring the waste toner into the chute 30. A shield 40 is attached to the end of the cartridge 20 and includes an opening 41 that aligns with the outlet port 21. The shield 40 is statically attached to the cartridge 20 with the opening 41 remaining aligned with the outlet port 21.

A door 25 is movably positioned over the port 21 and behind the shield 40. The door 25 is movable between a closed orientation as illustrated in FIG. 4 to prevent the waste toner from being transferred into the toner chute 30, and an open orientation as illustrated in FIG. 5 to allow waste toner to exit through the outlet port 21 into the toner chute 30. In the embodiments of FIGS. 4 and 5, the door 25 is connected to a lever arm 26 for movement between the orientations. A slot 27 is positioned in the member that extends between the door 25 and lever arm 26. A stationary pin 28 is positioned within the slot 27 to control an amount of movement between the orientations. A first end of the slot 27 contacts the pin 28 when the door is in the open orientation, and a second slot end contacts the pin 28 in the closed orientation. In the open orientation, the door 25 may completely clear the port 21 or may clear only a section of the port 21.

Shield 40 is positioned on the exterior of the door 25 to protect the door 25. Shield 40 is positioned a distance from the cartridge 20 forming a gap for housing the door 25. Opening 41 aligns with the port 21 and may be substantially the same size as the port 21. The shield 40 is statically mounted and does not move as the door 25 moves between the open and closed orientations.

The toner chute 30 includes an opening 31 for receiving the waste toner from the cartridge 20 as illustrated in FIG. 1. When the cartridge 20 is mounted to the toner chute 30, the outlet port 21 of the cartridge 20 aligns with the opening 31. A seal 32 as illustrated in FIG. 1 is positioned adjacent to the opening 31 to prevent waste toner leakage. The seal 32 is preferably constructed of a compliant resilient material such as foam. The seal 32 compresses when the cartridge 20 is mounted to the toner chute 30 to form a barrier to prevent leakage. Seal 32 may extend around a part or the entirety of the outlet port 62. The seal 32 may be attached to the waste toner chute 30, or the cartridge 20.

Seal 32 is positioned between the shield 40 and toner chute 30 when the cartridge 20 is mounted to the toner chute 30. Both the shield 40 and toner chute 30 are statically positioned and do not move as the door 25 moves between the open and closed orientations. The static contact forms a barrier to prevent toner leakage as the waste toner moves through the hand-off between the cartridge 20 and the chute 30. If the moving door 25 were to directly contact the seal 32, the movement may allow toner to leak, and the moving door 25 may also cause damage to the seal 32 as it moves between the open and closed orientations.

Figure 7:
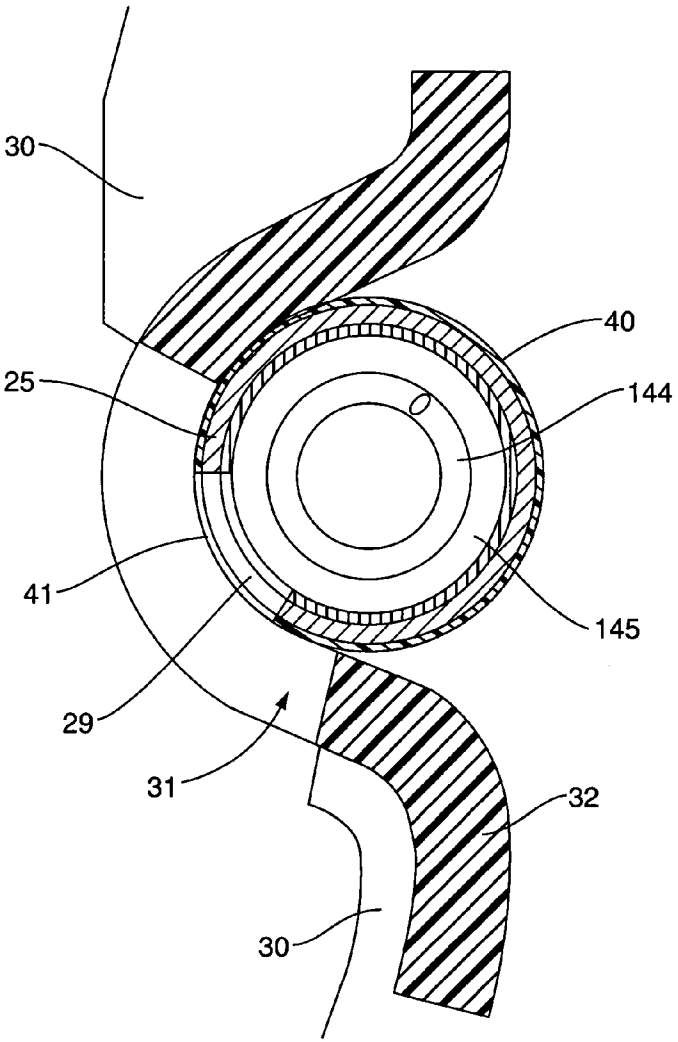
FIG. 7 is a cross section view of the cartridge mounted to the toner chute with the door in an open orientation according to one embodiment of the present invention.
Figure 6:
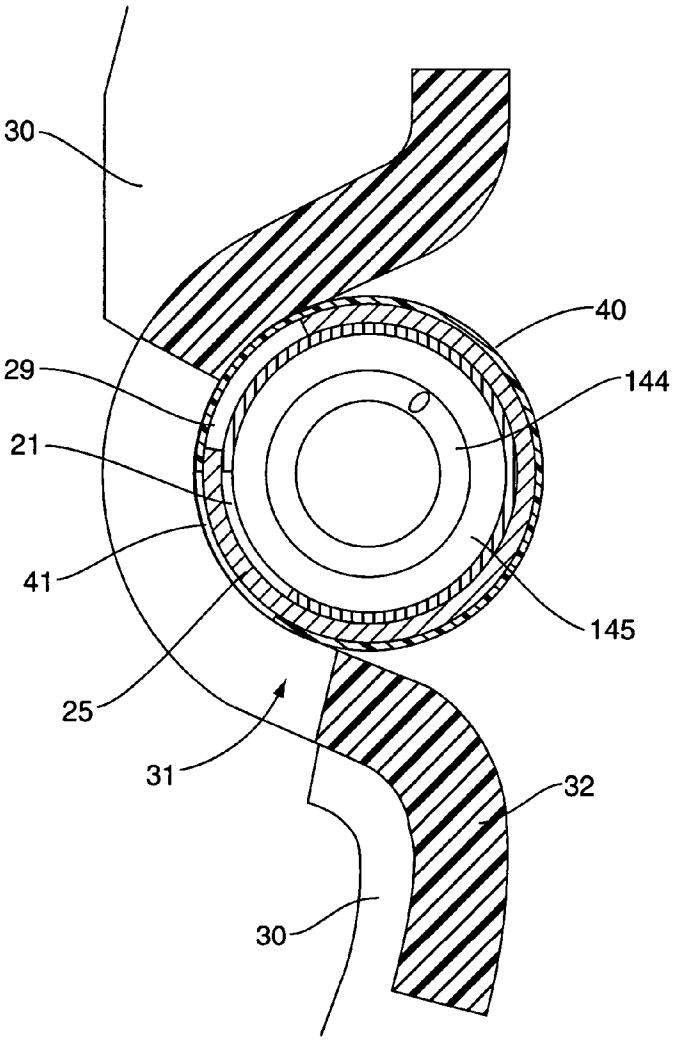
FIG. 6 is a cross section view of the cartridge mounted to the toner chute with the door in a closed orientation according to one embodiment of the present invention.

FIGS. 6 and 7 illustrate a cross section of the cartridge 20 mounted to the toner chute 30. FIG. 6 illustrates door 25 in the closed orientation and FIG. 7 illustrates the door 25 in the open orientation. Cartridge 20 includes the auger 144 positioned within the channel 145 of the cartridge housing 146. The waste toner is removed from the PC member 141 and moved within the channel 145 towards the outlet port 21 by rotation of the auger 144. The outlet port 21 extends through the cartridge housing 146 and aligns with the opening 41 in the shield 40.

Door 25 is positioned between the cartridge housing 146 and shield 40. Door 25 includes an opening 29 that is positioned away from opening 41 and the outlet port 21 in the closed orientation as illustrated in FIG. 6. The wall of the door 25 extends across the outlet port 21 and opening 41 to prevent waste toner from moving from the channel 145. In the open orientation of FIG. 7, door 25 is rotated with the opening 29 aligning with the opening 41 of the shield 40 and the outlet port 21 in the cartridge housing 146.

As illustrated in FIGS. 6 and 7, a barrier is formed by the seal 32 positioned between the shield 40 and the toner chute 30. Each of these elements remains stationary as the door 25 moves between the open and closed orientations. This interface prevents toner leakage, and spaces the moving door away from the seal 32.

Figure 8:
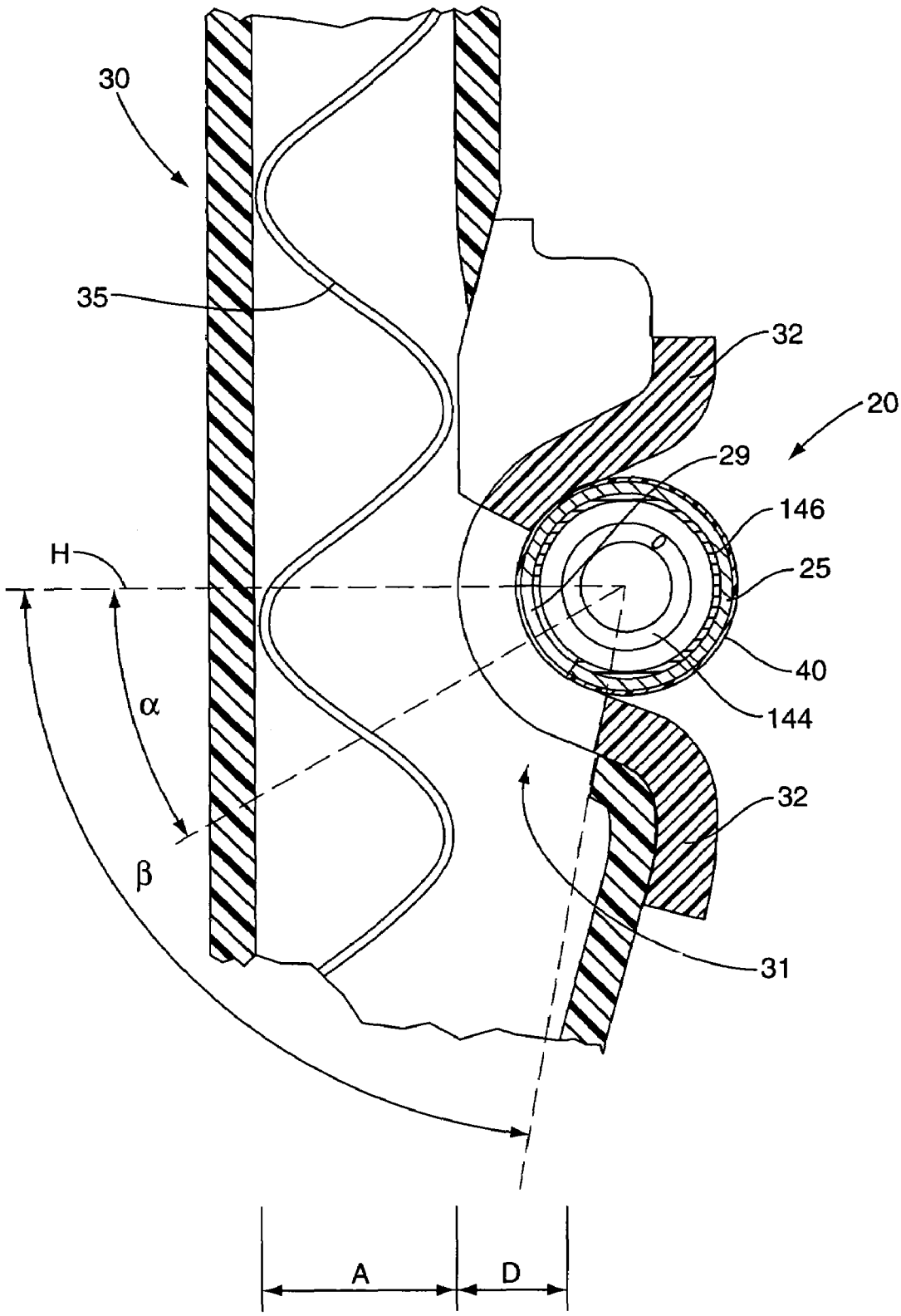
FIG. 8 is a schematic view of the cartridge mounted to the toner chute according to one embodiment of the present invention.

The placement of the cartridge 20 relative to the toner chute 30 allows for transfer of the waste toner and reduces the possibility of toner clogs. FIG. 8 illustrates the cartridge 20 mounted to the toner chute 30. The cartridge 20 is positioned against the seal 32 a distance away from the toner chute 30 and away from the sweep range A of the auger 35. A distance D between the opening 29 and the sweep range A is an area where the waste toner may clog during the handoff. The distance D is defined by the thickness of the cartridge housing 146, shield 40, and door 25, the compressed height of the seal 32, and the clearance between the waste toner chute 30 and the sweep range A of the auger 35.

To alleviate and/or prevent clogging, opening 29 is positioned such that the path of the waste toner exiting the cartridge 20 is roughly horizontal. This path is chosen to minimize the distance between the cartridge 20 and the sweep range A (the size D of the potential clog area increases the farther from horizontal the opening 29 is positioned). To further reduce the likelihood of a toner clog, opening 31 in the toner chute 30 has a larger vertical opening size from horizontal H. Opening 31 has an opening angle $\beta$ defined between the horizontal H and a lower edge of the opening 31. Opening 29 has an opening angle $\alpha$ defined between the horizontal H and a lower edge of opening 29. To reduce clogging, angle $\beta$ is greater than the outlet port opening $\alpha$. In one embodiment, angle $\beta$ is about 80° and angle $\alpha$ is about 30°. The angular placement below horizontal also allows for any waste toner on the toner chute side of the door 25 to fall into the toner chute 30 after the door is closed. The horizontal size of the opening 31 may also be greater than opening 29.

Figure 9:
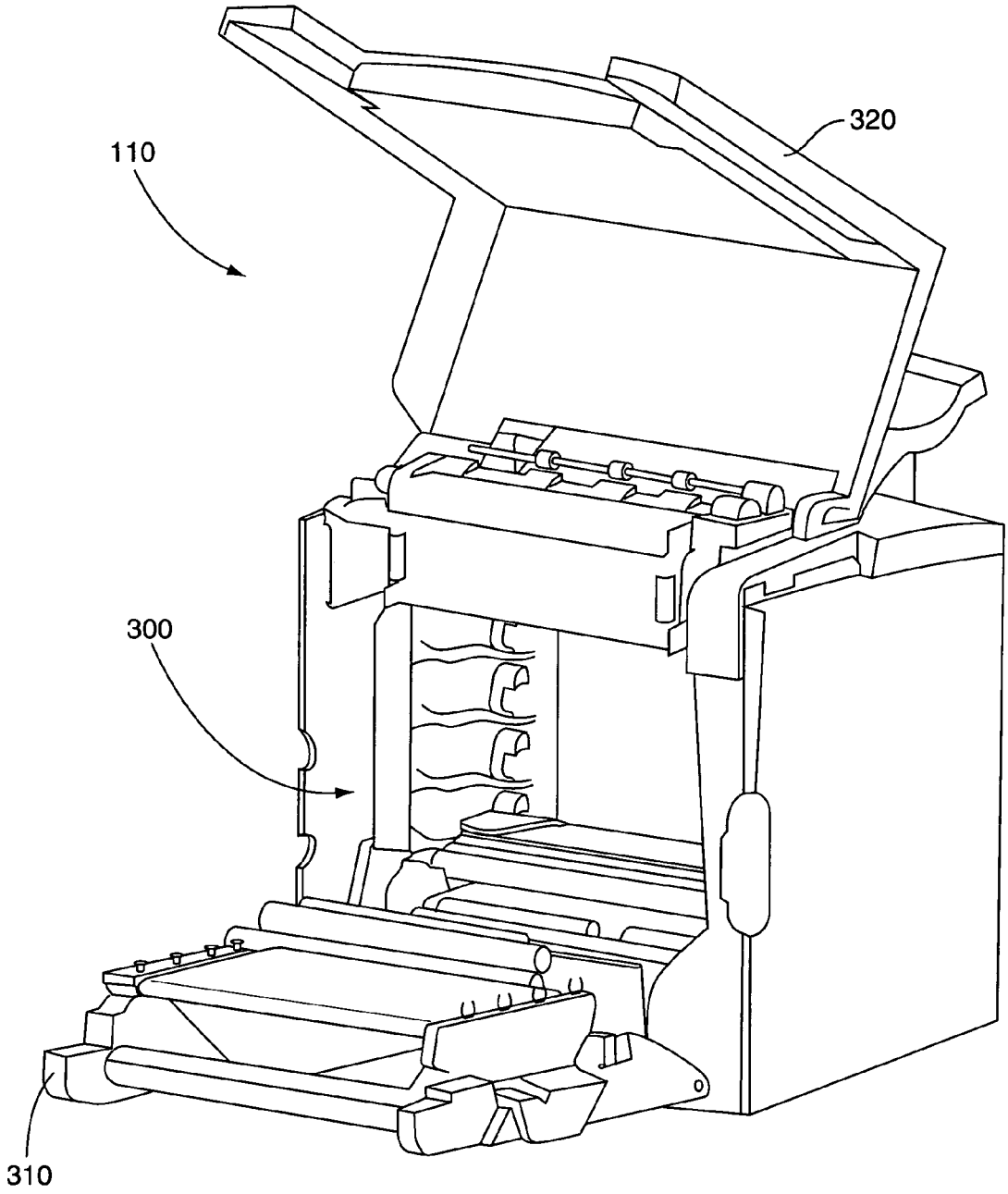
FIG. 9 is a perspective view of an image forming device according to one embodiment of the present invention.

Door 25 is closed when the cartridge 20 is removed from the device 110. The door 25 may also close depending upon the position of the device 110 as illustrated in FIG. 9. Device 110 includes an interior region 300 sized to contain the cartridges 20. A first door 310 and a second door 320 are each pivotally mounted between open and closed orientations, with FIG. 9 illustrating the doors 310, 320 in the open orientation. When the cartridge 20 is mounted within the interior region 300 and doors 310, 320 are in the closed orientation, the device is operational for producing printed documents and the door 25 is open to allow waste toner to move from the cartridge 20 and into the toner chute 30. When one or both doors 310, 320 are moved to the open orientation, door 25 moves to the closed orientation. Specifically, one or both of doors 310, 320 are operatively connected to arm 26 (see FIGS. 4 and 5). As one or both of the doors 310, 320 move between orientations, arm 26 connected with the door 25 rotates causing the door 25 to move between orientations. U.S. patent application Ser. No. 10/811,210 titled Waste Toner System for an Image Forming Device filed on Mar. 26, 2004 discloses opening and closing the cartridge and is herein incorporated by reference in its entirety.

The opening 41 on the shield 40 and the outlet port 21 may have the same size, or may have different sizes. In one embodiment, door 25 is substantially cylindrical and attaches to an end of the cartridge housing 146. The door 25 may have other configurations, and may have other attachments.

The present invention may be carried out in other specific ways than those herein set forth without departing from the scope and essential characteristics of the invention. In one embodiment, a biasing mechanism biases the door 30 towards the closed orientation. The present embodiments are, therefore, to be considered in all respects as illustrative and not restrictive, and all changes coming within the meaning and equivalency range of the appended claims are intended to be embraced therein.

What is claimed is:

1. An image forming device comprising:

a cartridge having a waste toner outlet;

a door aligned with the waste toner outlet and moveable between a closed orientation to prevent waste toner from discharging through the waste toner outlet and an open orientation to allow the waste toner to discharge through the waste toner outlet;

a shield attached to the cartridge and having an opening aligned with the waste toner outlet; and a waste toner chute having an inlet to receive the waste toner that is discharged from the cartridge through the waste toner outlet;

the shield positioned between the door and the waste toner chute to prevent the door from contacting the waste toner chute.

2. The device of claim 1, wherein a seal is positioned between the shield and the waste toner chute to prevent leakage of the waste toner moving through the waste toner outlet.

3. The device of claim 1, wherein the waste toner outlet in the cartridge has a smaller vertical size than the inlet in the waste toner chute.

4. The device of claim 3, wherein the inlet in the waste toner chute extends about 30° below horizontal and the opening of the waste toner chute extends about 80° below the horizontal.

5. The device of claim 1, wherein the waste toner outlet in the cartridge has a smaller horizontal size than the inlet in the waste toner chute.

6. The device of claim 1, wherein the door is rotatably mounted to the cartridge and rotates between the open and closed orientations.

7. The device of claim 1, wherein the waste toner chute has a substantially vertical orientation and the cartridge has a substantially horizontal orientation.

8. The device of claim 1, wherein the waste toner outlet is positioned at an end of the cartridge.

9. An image forming device comprising:

a cartridge having a waste toner outlet;

a door aligned with the waste toner outlet and moveable between a closed orientation to prevent waste toner from discharging through the waste toner outlet and an open orientation to allow the waste toner to discharge through the waste toner outlet;

a shield attached to the cartridge and having an opening aligned with the waste toner outlet; and a waste toner chute having an inlet to receive the waste toner that is discharged from the cartridge through the waste toner outlet;

the shield being positioned on an exterior of the cartridge between the door and the waste toner chute to prevent the door from contacting the waste toner chute;

the inlet being positioned at least partially below a lower edge of the waste toner outlet.

10. The device of claim 9, wherein the cartridge comprises a channel to receive the waste toner from a photoconductive member, the waste toner outlet being positioned at an end of the channel.

11. The device of claim 9, wherein the door is rotatably positioned within a gap formed between the shield and the cartridge.

12. The device of claim 11, further comprising a stop mechanism to control an extent of rotation of the door between the open and closed orientations.

13. The device of claim 9, further comprising an auger positioned within the waste toner chute.

14. The device of claim 9, wherein the waste toner outlet and opening are each substantially the same size.

15. The device of claim 9, wherein the waste toner chute is substantially vertically oriented and the cartridge is substantially horizontally oriented.

16. A device that mounts within an image forming device comprising:

a photoconductive member;

a channel substantially aligned with the photoconductive member and sized to contain waste toner removed from the photoconductive member;

an outlet port to discharge the waste toner from the channel;

a door positionable between an open orientation to allow the waste toner to be discharged through the outlet port and a closed orientation to prevent the waste toner from being discharged; and a shield statically positioned at an exterior of the door and having an opening aligned with the outlet port, the shield positioned to allow the door to move between the open and closed orientations.

17. The device of claim 16, wherein the channel is formed in a housing and the outlet port extends through a wall of the housing.

18. The device of claim 17, wherein the door is rotatably mounted to the housing and rotates between the open and closed orientations.

19. The device of claim 16, wherein a lower edge of the outlet port is positioned about 30° below horizontal.

20. The device of claim 16, further comprising a foam seal positioned on an exterior side of the opening in the shield to prevent leakage of the waste toner that moves through the outlet port.

* * * * *